United States Patent [19]

Celada-Salmon

[11] Patent Number: 4,853,942

[45] Date of Patent: Aug. 1, 1989

[54] GRAPHITE ELECTRODE WITH INTERNAL COOLING FOR ELECTRIC ARC FURNACES

[75] Inventor: Juan Celada-Salmon, Garza Garcia, Mexico

[73] Assignee: Hylsa, S.A. De C.V., Monterrey, Mexico

[21] Appl. No.: 81,838

[22] Filed: Aug. 5, 1987

[30] Foreign Application Priority Data

Aug. 5, 1986 [MX] Mexico ..... 3383

[51] Int. Cl.[4] ..... H05B 7/12; H05B 7/14

[52] U.S. Cl. ..... 373/91

[58] Field of Search ..... 373/91, 92, 93

[56] References Cited

U.S. PATENT DOCUMENTS 4,498,185 2/1985 Elsner et al. ..... 373/93

FOREIGN PATENT DOCUMENTS 115812 8/1984 European Pat. Off. ..... 373/93

*Primary Examiner*—Roy N. Envall, Jr.

*Attorney, Agent, or Firm*—A. Thomas S. Safford

[57] ABSTRACT

Graphite consumable electrode for electric arc furnaces and the like, which comprises a plurality of essentially similar graphite sections and coupled one to the other by means of threaded connections, wherein each section is provided with cooling conduits formed into it, through which a cooling fluid flows fed only through the upper portion of the electrode from a distributing header with the lower tip portion of the electrode being automatically isolated from the cooling fluid flow.

19 Claims, 2 Drawing Sheets

GRAPHITE ELECTRODE WITH INTERNAL COOLING FOR ELECTRIC ARC FURNACES

FIELD OF THE INVENTION

The invention relates to a graphite electrode used in an electric arc furnace or the like and more particularly to a consumable electrode which comprises various sections, is resistant to lateral oxidation, and is internally cooled.

BACKGROUND OF THE INVENTION

In the operation of metallurgical furnaces, e.g., electric arc furnaces, the graphite electrode is generally used because its mechanical and electrical properties are suited to tolerate the adverse conditions within this type of furnace. Nevertheless, the electrodes should moreover tolerate consumption due to erosion, corrosion, oxidation, sublimation by arcing, spalling, and other adverse factors, such as electrode fractures and electrode losses within the melt.

For electric arc furnaces, the consumption caused by lateral oxidation may range up to 40% of the total electrode consumption, while the tip consumption may range up to 60%.

Various ways have been suggested to lower the graphite electrode consumption. Tip consumption is due to the normal use within the furnace; and fractures and other similar losses, such as from arcing, can be minimized through adequate control of the electrode height. Numerous efforts have been particularly made to solve the additional significant problem caused by lateral oxidation losses. One method of reducing graphite electrode consumption has been the utilization of non-consumable metallic electrodes which have a cooled non-consumable upper portion, at whose bottom portion is affixed a graphite tip by means of a nipple. This type of electrode has the disadvantage of requiring special insulation to avoid arcing with other conductive parts, e.g., with steel scrap, as well as numerous problems in its use caused by the insulation and some difficulties in transferring electrical energy.

Another suggested way to decrease the graphite electrode consumption requires the application of external protective coatings of materials resistant to oxidation. These coatings cause an increase in the contact resistance between the electrode and the power clamp, which causes a decrease of the energy transferred to the melt and consequently an increase on the energy required to melt down the charge. Compound electrodes of the type disclosed on U.S. Pat. Nos. 4,490,824 and 4,498,185 are known.

U.S. Pat. No. 4,490,824 discloses a compound electrode provided with two concentric passages arranged vertically along the axis of the electrode. This electrode has the disadvantage of lacking sufficient cooling of its lateral surfaces, leaving unsolved the lateral consumption problem. Moreover, the cooled portion is non-consumable and requires special nipples.

U.S. Pat. No. 4,498,185 discloses a compound electrode within which a plurality of copper tubes, radially arranged, extend longitudinally along the electrode and are serially interconnected to allow the coolant fluid to pass therethrough. This type of electrode is non-consumable and its type of interconnection prevents homogeneous cooling.

OBJECTS OF THE INVENTION

It is an object of the invention to provide a consumable graphite electrode in which the lateral consumption is substantially decreased.

It is a further object of the invention to provide such a consumable graphite electrode which may be used in the same manner as is a normal consumable graphite electrode.

BRIEF DESCRIPTION OF THE INVENTION

A preferred embodiment of the present invention comprises a cooled electrode for electric arc furnaces or the like, which comprises a plurality of identical sections, each provided with a plurality of conduits formed therein. Such conduits mainly extend longitudinally along the electrode in a cylindrical array with supply channels and bypass lines for establishing a flow network through which a coolant fluid flows. Said flow network directly cools the two upper sections of the electrode and automatically prevents the cooling fluid from supplying the lower section(s). The cooling fluid is fed to the uppermost section of the electrode through a distributing header via a circular distributing channel located at the upper portion of the electrode. A similar adjacent and concentric channel acts as a collector of the cooling fluid exiting the electrode and passes such fluid through the distributing header and on out of the electrode. The distributing header is provided in its bottom portion, with a drilled threaded connector to which the first section is attached, and which allows the cooling fluid to flow via the first section through the bypass lines therein to similar channels located at the upper portion of the second section of the electrode. Said graphite sections of the electrode may be treated internally and externally with at least one or more coatings of a sealant of the type generally used in the art, e.g., an acrylic resin, to avoid cooling fluid losses to the metal melt.

This electrode decreases the operating costs of the electric arc furnace, because it is highly resistant to lateral corrosion. Since it is consumable in the normal way and is easily disassembled, it permits the addition of new sections of electrode in the upper part of the column without coolant losses through the lowermost sections being consumed.

DESCRIPTION OF THE DRAWINGS

In this specification and the accompanying drawings, Applicant has shown and described several preferred embodiments of his invention and has suggested various alternatives and modifications thereto, but it is to be understood that these are not intended to be exhaustive and that many changes and modifications can be made within the scope of the invention. These suggestions herein are selected and included for purposes of illustration in order that others skilled in the art will more fully understand the invention and the principles thereof and will thus be enabled to modify and embody it in a variety of forms, each as may be best suited to the conditions of a particular use.

DETAILED DESCRIPTION OF A PREFERRED EMBODIMENT OF THE INVENTION

Figure 1:
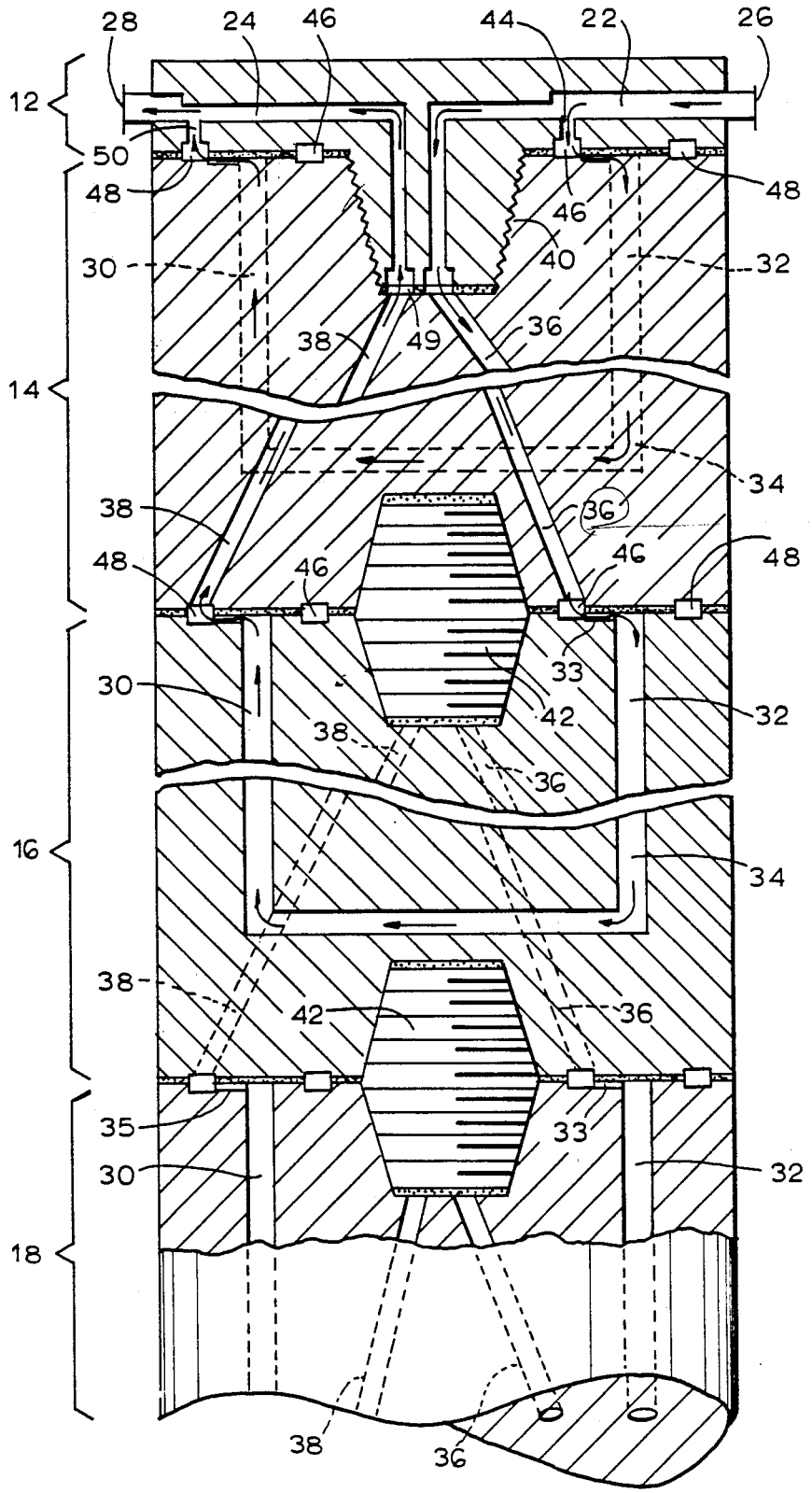
FIG. 1 is a longitudinal section through the electrode with the cooling conduits and the distributing channels being illustrated in a configuration designed for ease of description.

FIG. 1 shows a longitudinal section of the electrode which comprises a head 12 and three electrode sections 14, 16, and 18. Section 18 is identical to sections 14 and 16 but as shown is uncooled. Header 12 is axially coupled to section 14 by means of a threaded connection 40. Sections 14, 16, and 18 are firmly axially coupled one to the other by means of threaded nipples 42 located in the center of the transverse section of the electrode. Threaded nipples 42 shown are formed of graphite and are of the type generally used in the art. Though shown as a conventional separate unit, each threaded nipple 42 could alternatively be formed as an upstanding integral part of one end of each electrode section, with the other end of each such section having a correspondingly threaded recess.

Header 12 is a distributing header for the cooling fluid. Its other main function is as a support structure and as such can best be made from steel or other appropriate material. The cooling fluid enters into header 12 through the inlet tube 26, continues through conduit 22, wherein at a given point the flow of cooling fluid splits to continue, on one hand through conduit 22 to connector 40, and on the other hand through passage 44 towards the circular distributing channel 46. From said distributing channel 46 serves as a cooling fluid supplying conduit from which the cooling fluid is distributed to a plurality of cooling conduits 32, which are preferably arranged equidistantly one to another and at the same radial distance from the longitudinal central axis of the electrode. Each electrode section includes a network of cooling conduits through which said cooling fluid flows, inclusively downwardly through cooling conduits 32, thence through horizontal cooling conduits 34, and upwardly through cooling conduits 30 to the circular collecting channel 48. From the collecting conduit 48 the flow continues on through the distributing header 12 via conduits 50, 24 and 28, and back outside to the exterior of the electrode to exit through outlet tube 28. The portion of the cooling fluid that splits and passes through conduit 22, flows downwardly through the center of threaded connection 40 into a descending diagonal bypass supplying conduit 36 and thence into section 16. More particularly, conduit 36 is coupled to the circular distributing channel 46 in the upper portion of the next section 16. From that point on, the cooling fluid is distributed to cooling conduits 32, 34, and 30, and outlet channel 48 of section 16 in a manner essentially the same as through section 14. The cooling fluid collected by means of channel 48 in the upper portion of section 16 flows upwardly to the distributing header 12 through the ascending diagonal bypass conduit 38 of section 14. Conduit 38 couples with circular collecting channel 49 in the upper portion of section 14 at the base of the recess for threaded connection 40. Channel 49 is concentric to the discharge end of conduit 22 centered in connection 40. Channel 49 also couples with lowermost inlet to conduit 24 located in the bottom face of connection 40, thus permitting the flow from bypass 38 to pass through the conduit 24, mixing with the cooling fluid from conduit 50, and then leaving the electrode through the outlet 28.

The channels 46, 48 and 49 are circular so that when a new electrode section is screwed onto the top of the electrode (header 12 and section 14) there is no alignment problem with the conduits coupled thereto (such as conduits 44, 36, 50, 38 and 24, respectively). For the same reason, the inlet to conduit 38 and the outlet from conduit 22 are aligned in the center of the electrode.

Channels 46 and 48 are shown partially formed into the upper surface of a section and are partially formed into the lower surface of the section (and/or of the header 12), such that adjacent sections and/or header mate to form complete channels. Alternatively, the channels could be formed wholly in either the upper or in the lower surface exclusively.

Figure 2:
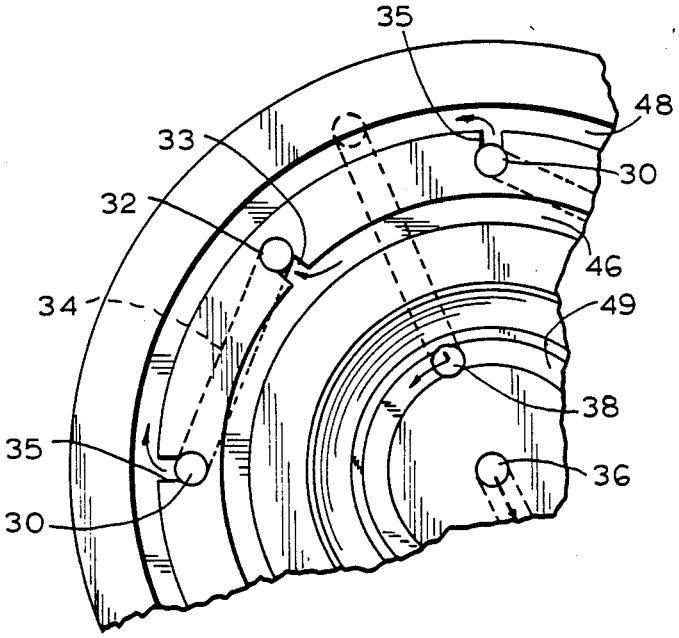
FIG. 2 is a plan view of a modified electrode section illustrating the flow conduits and distributing channels in the preferred configuration.
Figure 3:
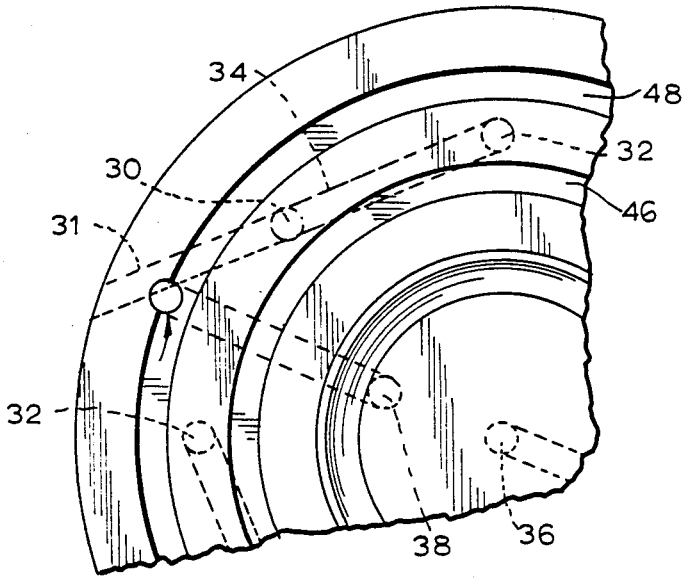
FIG. 3 is a view of the bottom portion of the electrode section of FIG. 2.

In the illustrated preferred embodiment of FIGS. 2 and 3, the parallel cooling conduits 30 and 32 alternate every 45° and adjacent pairs 30,32 are joined by a horizontal conduit 34. As shown in FIG. 3 the hole drilled to form conduit 34 leaves a passage 31, which is then plugged. As shown, conduits 34 are perpendicular to a radius of the circular cylindrical electrode. Since the concentric supply channel 46 and collecting channel 48 have different radii from each other and from the common radius of the conduits 30, 32; the channel 46 therefore has radial passages 33 to connect with conduits 32, and similarly radial passages 35 connect the channel 48 with conduits 30.

When the electric furnace is operating normally, conduits 36 and 38 of section 16 are not in communication with any supply channels 46, 48 or connection 40, and also, are plugged by means of threaded nipple 42. Consequently, diagonal conduits 36 and 38 of section 16 remain inactive, since there is no supply of cooling fluid.

Since the cooling fluid is prevented from flowing through diagonal conduits 36 and 38 of section 16, there is no bypass flow to section 18. Thus, section 18 and any lower sections of the electrode are not cooled. As a result, said section 18 and any lower sections act as a normal electrode tip, and are consumed in the usual way.

This improved electrode operates in the electric arc furnace essentially as a normal electrode, except with greatly enhanced longevity. This combines the best features of the conventional electrode without the drawbacks of the prior water-cooled electrodes.

Since header 12 is easily dismounted, without separating the electrode from the power clamp, it is possible when section 18 is nearly consumed, to add to the upper portion of the column, a new section (similar to sections 14, 16 and 18) and then move the electrode downwardly as section 18 is further consumed. When this is done, only the new section and former section 14 are cooled, former section 16 now being isolated and available to be consumed in turn (as is section 18) without disgorging cooling fluid into the furnace.

All the conduits in this electrode may be internally treated with any of the resins normally used in the art to avoid leakages of cooling fluid to the outside of the electrode.

From the foregoing description it should be apparent that the present invention provides an improved cooled electrode capable of achieving the objectives and providing the advantages outlined above. By utilizing an electrode described, lateral corrosion problems are substantially eliminated because it provides homogeneous cooling of the electrode (since the cooling conduits are located relatively shallowly under the lateral surfaces of the electrode which confront the furnace, and said conduits are connected in a parallel cylindrical array between the distributing channels). Another apparent advantage of the preferred embodiment is that, by its construction, this type of electrode allows the cooling of the two upper sections out of the three or more which normally comprise the electrode for electric arc furnaces.

The problem of how to have good cooling circulation in an all graphite consumable electrode and not have to manipulate the interior of the electrode sections once in place and yet still be able to prevent loss of cooling fluid from the tip being consumed has long plagued this art. The applicant has very cleverly solved this problem by preferably having at least three sections with at least two being constantly cooled with the remainder being blocked from the cooling fluid merely by the structural configuration of the cooling flow network which prevents cooling from passing beyond the second section.

In the broader aspects of this invention, the particular conduit and channel network configuration can be substantially modified from the structure of the preferred embodiment shown in the drawings.

For example, the distributor header 12 could have a third inlet-outlet pair (like 22,24 and 44,50) commonly supplied by tubes 26, 28, that would feed to and from the bottom face of connector 40 (respectively, via two separate connector channels concentric between the inlet to line 36 and channel 49) through a second respective pair of bypass lines (similar to 36, 38), which second bypass lines pass vertically down (parallel to the electrode axis) to two respective nipple channels in the bottom nipple recess face of the given electrode section (which nipple channels have the same concentricity, i.e. radii, as the aforementioned two separate connector channels) and, finally, each nipple 42 would be drilled with two oblique passages positioned such that one such oblique passage connects the inlet separate connector channel in the bottom of one electrode section (e.g. 14) to the inlet nipple channel in the upper face of next lower electrode section (e.g. 16) and the other such oblique passage connects the corresponding outlet separate connector channel to the corresponding outlet nipple channel. With this additional structure, the top three sections 14, 16 and 18 (not just the top two), will receive circulating cooling fluid, but the next lower electrode section will not. In other words, the loop 32,34,30 in section 14 is supplied by the inlet-outlet pair 44,50; the equivalent loop in section 16 is supplied by the inlet-outlet pair 22,24 via the bypass lines 36,38 of section 14; and additionally the equivalent loop in section 18 is supplied by the aforementioned third inlet-outlet pair via the vertical second bypass lines and the oblique passages in the drilled nipple 42 positioned between sections 14 and 16 and thence via the bypass lines 36,38 of section 16. No cooling fluid can flow into the equivalent loop in the sections below section 18, because the vertical second bypass lines in section 16 would not register with the oblique passages in the nipple between sections 14 and 16, nor with any interconnecting channel.

It is, of course, to be understood that the foregoing description is intended to be illustrative only. Numerous other changes within the scope of the invention will be apparent to those skilled in the art.

What is claimed is:

1. A consumable graphite electrode for electric arc furnaces and the like, which comprises at least three graphite sections coupled to each other by connecting means, at least two of said sections being internally cooled by means of a cooling fluid flowing therethrough, each section having a main graphite body with a plurality of cooling conduits formed therein with said cooling conduits having at least an inlet and an outlet for the cooling fluid, a first cooling fluid supplying conduits coupled to said cooling conduits of the main graphite body, a second cooling fluid supplying conduit to lead said cooling fluid as a bypass from one end to the other end of the main graphite body and positioned to communicate at said other end with the first cooling fluid supplying conduit for any next section, a first cooling fluid collecting conduit coupled to said cooling conduits, and a second cooling fluid collecting conduit to lead said cooling fluid as a bypass back from the other end to the one end of said main graphite body and positioned to communicate at said other end with the first cooling fluid collecting conduit for any next section.

2. An electrode according to claim 1, wherein said internal conduits are coupled in parallel with said first cooling fluid supplying conduit.

3. An electrode according to claim 1, wherein said internal conduits are coupled serially with said first cooling fluid supplying conduit.

4. An electrode according to claim 1, wherein the section opposite to the electric arc is coupled to a cooling fluid distributing header.

5. An electrode according to claim 4, wherein said head has at least two supplying inlets for the cooling fluid, one of which is coupled to said first cooling fluid supplying conduit of the adjacent section and the other is coupled to said second cooling fluid supplying conduit of the adjacent section, and at least two collecting outlets for the cooling fluid, one of which is coupled to said first cooling fluid collecting conduit of the adjacent section, and the other is coupled to said second cooling fluid collecting conduit of the adjacent section.

6. An electrode according to claim 5, wherein the internal conduits of each main graphite body are internally treated with a coating impermeable to the cooling fluid.

7. An electrode according to claim 6, wherein said cooling fluid is water.

8. A graphite consumable electrode for electric arc furnaces and the like, which comprises functionally interchangeable sections, n of which are cooled and at least the last of which is not cooled, where n is an integer of two or more, connection means for coupling said sections to each other seriatim, header means for supplying cooling fluid to the uppermost of said sections for use in circulating through the first n sections and for receiving said cooling fluid back from uppermost section, each section being a main graphite body having a network of cooling conduits formed therein and having n-1 pairs of bypass conduits also formed therein with each pair positioned to form part of resulting respective supply conduits to and from the header to each corresponding respective cooling conduit network in each of the first n sections, such that the network in the uppermost section is supplied with cooling fluid directly from the adjacent header means and each network of the other first n sections is individually supplied via a respective closed loop formed form intercoupling together of one pair of bypass conduits from each intervening section.

9. An electrode according to claim 8, wherein the electrode has $n+1$ sections, with is no flow of cooling fluid to the $n+1$ section of said electrode down from said header means cause there are only $n-1$ bypass pairs in each section, and wherein n is an integer of from 2 to 5.

10. An electrode according to claim 8, wherein the electrode has only three sections and thus each section has only one pair of bypass conduits, said network of cooling conduits having at least an inlet and an outlet for the cooling fluid, a first cooling fluid supplying conduit coupled to said cooling conduits of the main graphite body, one of bypass conduits being a second cooling fluid supplying conduit to lead said cooling fluid as a bypass from one end to the other end of the main graphite body and positioned to communicate at said other end with the first cooling fluid supplying conduit for any next section, a first cooling fluid collecting conduit coupled to said cooling conduits, and the other of said pair of bypass conduits being a second cooling fluid collecting conduit to lead said cooling fluid as a bypass back from the other end to the one end of said main graphite body and positioned to communicate at said other end with the first cooling fluid collecting conduit for any next section.

11. An electrode according to claim 10, wherein said header means is a cooling fluid distributing header having at least two supplying inlets for the cooling fluid, one of which is coupled to said first cooling fluid supplying conduit and the other is coupled to the one end of said second cooling fluid supplying conduit, and at least two collecting outlets for the cooling fluid, one of which is coupled to said first cooling fluid collecting conduit and the other is coupled to the one end of said second cooling fluid collecting conduit.

12. An electrode according to claim 11, wherein said internal conduits are coupled in parallel between said first cooling fluid supplying conduit and said first cooling fluid collecting conduit.

13. An electrode according to claim 12, wherein the conduits of the main graphite body are internally treated with a coating impermeable to the cooling fluid.

14. An electrode according to claim 12, wherein the coupling between sections and between the header and a section include circular channels obviating the need for precise angular alignments of conduits between sections when coupled by said connection means.

15. An electrode according to claim 9, wherein said graphite sections are all effectively of the same construction.

16. An electrode according to claim 11, wherein said graphite sections are all essentially identical and wherein the coupling between sections and between the header and a section include circular channels obviating the need for precise angular alignments of conduits between sections when coupled by said threaded connections.

17. A consumable coolable graphite electrode section capable of being coupled with similar sections to form an electrode useful in electric furnaces, said electrode section comprising a generally cylindrical body of graphite having opposite ends adapted to be coupled to adjacent similar sections, at least one of said ends having inlet and outlet channels therein and said graphite body having a network of coolant passages therein interconnecting said inlet and outlet channels, said channels and said network being configured within said section such that said section is capable of being coupled with a series of like sections, totaling n in number where n is an integer from 2 to 5, to give an electrode where the nth section only is isolated from coolant passages originating from the first section.

18. An electrode section according to claim 17 wherein said inlet and outlet channels are circular and concentric with the axis of said cylindrical graphite body.

19. An electrode section according to claim 18 wherein inlet and outlet channels are present in both ends of said cylindrical graphite body.

* * * * *